United States Patent [19]

Ueyama et al.

[11] Patent Number: 4,457,281

[45] Date of Patent: Jul. 3, 1984

[54] FUEL INJECTION DEVICE FOR A MULTICYLINDER ENGINE

[75] Inventors: Yoshiji Ueyama, Kobe; Yoshiaki Asayama, Himeji, both of Japan

[73] Assignee: Mitsubishi Denki Kabushiki Kaisha, Tokyo, Japan

[21] Appl. No.: 376,215

[22] Filed: May 7, 1982

[30] Foreign Application Priority Data

May 15, 1981 [JP] Japan ..... 56-74010

[51] Int. Cl.[3] ..... F02B 3/00

[52] U.S. Cl. ..... 123/482; 123/472; 123/494; 123/458; 123/460

[58] Field of Search ..... 123/472, 494, 458, 460, 123/482

[56] References Cited

U.S. PATENT DOCUMENTS

| | | | |
|---|---|---|---|
| Re. 27,909 | 2/1974 | Huber | 123/472 |
| 3,722,275 | 3/1973 | Rodely et al. | 123/494 |
| 3,818,877 | 6/1974 | Barrera et al. | 123/494 |
| 3,881,352 | 5/1975 | McShane | 123/494 |
| 3,965,730 | 6/1976 | Innes | 123/494 |
| 3,967,596 | 7/1976 | Comley | 123/494 |
| 4,235,205 | 11/1980 | Fukui | 123/472 |
| 4,250,842 | 2/1981 | Sutton | 123/472 |
| 4,257,376 | 3/1981 | Wen | 123/472 |
| 4,263,884 | 4/1981 | Suzuki | 123/494 |
| 4,336,782 | 6/1982 | Endo | 123/494 |

*Primary Examiner*—Ronald B. Cox

*Attorney, Agent, or Firm*—Wenderoth, Lind & Ponack

[57] ABSTRACT

An electronic fuel supply device for an automotive engine has a vortex flow sensor for sensing the flow of suction air into the engine, an electromagnetic valve which driven for a predetermined time in synchronism with the frequency output from the vortex flow sensor so as to permit the passage of fuel therethrough, and a control valve for limiting the flow of fuel through the electro-magnetic valve. The fuel is metered by the electro-magnetic valve and the control valve, and the fuel may thus be supplied in metered amounts to the fuel injection valves in the respective cylinders for injection into the engine.

2 Claims, 1 Drawing Figure

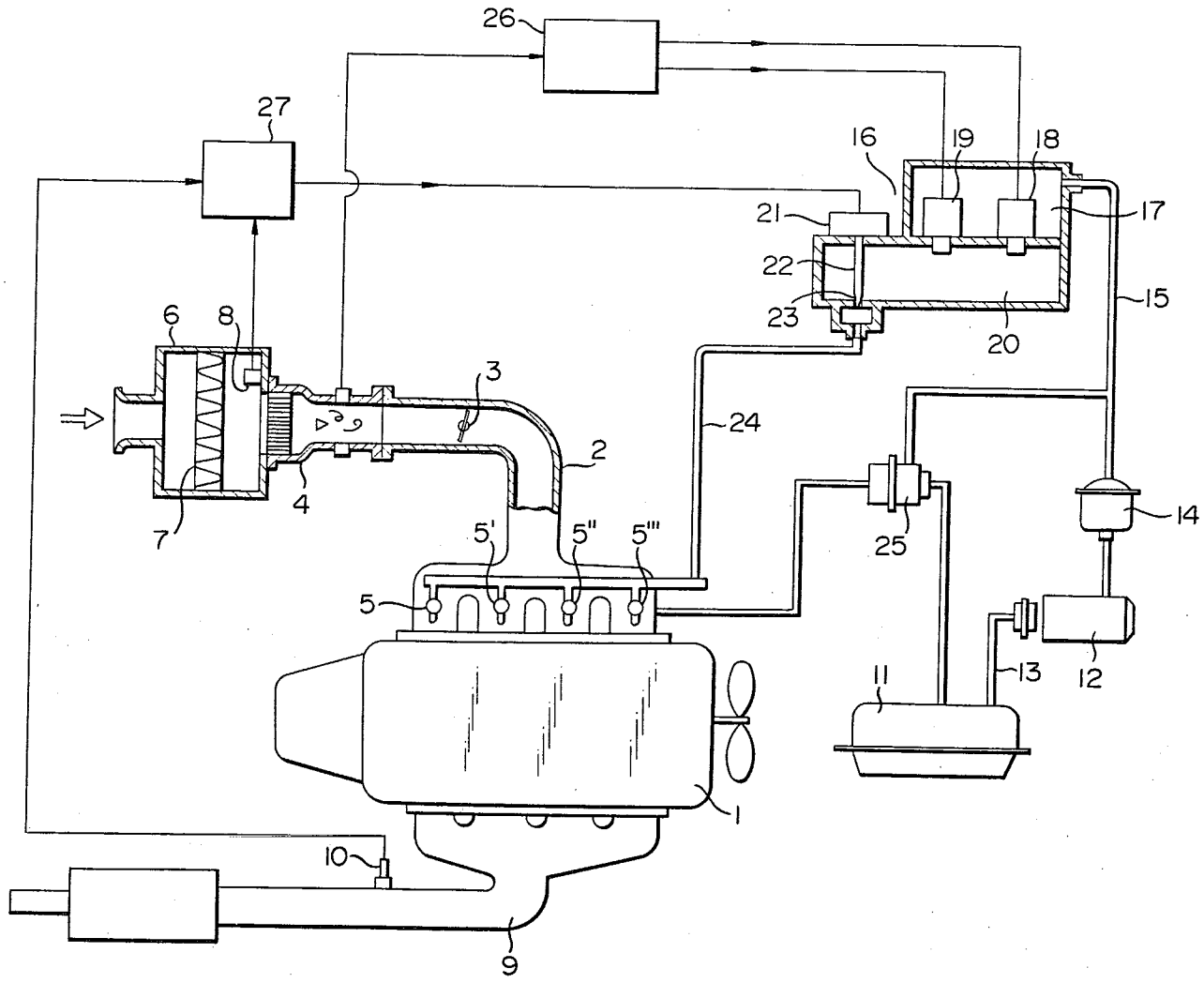
1
2
3
4
5
5'
5''
5'''
6
7
8
9
10
11
12
13
14
15
16
17
18
19
20
21
22
23
24
25
26
27

FUEL INJECTION DEVICE FOR A MULTICYLINDER ENGINE

BACKGROUND OF THE INVENTION

1. Field of the Invention

This invention relates to an electronic fuel supply device for automotive engine and more particularly to a fuel supply device for a multicylinder engine which comprizes a vortex flow sensor for sensing the amount of suction air into the engine and a fuel metering device including electro-magnetic valves driven for a predetermined time in synchronism with the frequency output from the vortex flow sensor and a control valve operable to limit the flow of fuel through said electro-magnetic valves, the fuel being supplied to fuel injection valves in the respective cylinders in an amount metered by the fuel metering device.

2. Description of the Prior Art

It is well known that a vortex flow sensor affords a frequency output signal corresponding to the vortex speed (or the number of generated vortices) which is proportional to the flow of suction air being measured. It is thus contemplated to supply to the engine an amount of fuel referenced to the frequency output of the vortex sensor which is proportional to the suction air flow. The flow of suction air for a 2000 cc engine ranges from about 2 liters/sec. for idling to about 85 liters/sec. for a maximum speed which is 40 to 45 times the fuel flow for idling. On the other hand, the injection frequency of the fuel injection electro-magnetic valves has the maximum value of 200 to 250 Hz as a practical limit. The injection frequency for idling of the same engine should be 10 Hz or more; otherwise, the vehicle may be subjected to torque fluctuations. Thus, the frequency for the magnetic valve is changed in a range of from a minimum to about 20 times such a minimum. The total range of variations in the suction air flow (40 to 45 times) may not be covered by a single electro-magnetic valve designed to inject fuel in a timed relationship with the vortex speed. For such case, a plurality of electro-magnetic fuel injection valves are employed. If such fuel injection valves are to be mounted to each cylinder of a multi-cylinder engine, a plurality of such injection valves will be required for each cylinder, resulting in a complicated structure and prohibitive cost.

SUMMARY OF THE INVENTION

In consideration of these disadvantages of the prior-art device, the present invention envisages to provide one fuel injection valve to each cylinder and to supply fuel to the fuel injection valve in each cylinder in an amount metered by a fuel metering device which comprises electro-magnetic valves and a control valve. The electro-magnetic valves are driven for a predetermined time in synchronism with the frequency output from a vortex flow sensor sensing the flow of suction air in the engine, and the control valve operates to limit the flow of fuel through said electro-magnetic valves. In this manner, the fuel metering device with the electro-magnetic valves is separated from the fuel injection valves mounted to the respective cylinders, so that the number of expensive electro-magnetic valves may be reduced to provide a simplified fuel supply device for a multicylinder engine.

BRIEF DESCRIPTION OF THE DRAWING

The drawing illustrates a simplified view of a preferred embodiment of the present invention.

DESCRIPTION OF THE PREFERRED EMBODIMENT

In the drawing, numeral 1 denotes an engine and numeral 2 denotes a suction manifold for the engine 1. Numeral 3 denotes an air throttle valve. Numeral 4 denotes a vortex flow sensor for sensing the amount of suction air into the engine 1. Numerals 5, 5', 5'', 5''' denote fuel injection valves mounted to respective cylinders of the engine 1. Numeral 6 denotes an air cleaner and numeral 7 denotes an air cleaner element (filter paper). Numeral 8 denotes a suction air temperature sensor. Numeral 9 denotes an exhause pipe of the engine 1. Numeral 10 denotes an oxygen concentration sensor for sensing the oxygen concentration in the exhaust gas. Numeral 11 denotes a fuel tank, and numeral 12 denotes a fuel pump, the suction side of which is connected to said fuel tank 11 by pipe 13 and the discharge side of which is connected to a chamber 17 of a fuel metering device 16 by way of a fuel filter 14 and a pipe 15. Numerals 18 and 19 denote electro-magnetic valves mounted between said chamber 17 and a further chamber 20. Numeral 21 denotes a pulse motor and numeral 22 denotes a control valve (needle valve) driven or controlled by the pulse motor 20. Numeral 23 denotes a fuel metering orifice cooperating with said control valve 22 to limit fuel flow supplied to said fuel injection valves 5, 5', 5'', 5''' from said chamber 20 by way of pipe 24. Numeral 25 denotes a fuel pressure adjustment device by means of which the pressure of fuel supplied under pressure to said chamber 17 my be maintained at a predetermined value. Numeral 26 denotes a drive circuit for electro-magnetic valves 18 and 19 for driving said valves sequentially for a predetermined time interval in synchronism with frequency outputs from the flow sensor 4. Numeral 27 denotes a drive circuit for said control valve 22. The drive circuit 27 is operated by output signals from the suction air temperature sensor 8 and from the oxygen concentration sensor 10, and is designed to drive or control said pulse motor 21 as a function of auxiliary factors such as the air/fuel ratio feedback value.

The device so far shown and described operates as follows: When the engine 1 is started, suction air is introduced from air cleaner 6 into the vortex flow sensor 4 where the air flow is determined. The suction air is introduced via suction manifold 2 into the engine 1. On the other hand, fuel contained the in fuel tank 11 is pumped by the fuel pump 12 into the chamber 17 of the fuel metering device 16. The fuel in the chamber 17 is introduced into the chamber 20 during the time that the valves 18 and 19 are open or operative. The valves 18 and 19 are driven for a predetermined time interval by the drive circuit 26 sequentially and in timing with frequency outputs from the vortex flow sensor 4 which are referenced to the suction air flow. The fuel passing through the valves 18 and 19 while the latter are open is supplied to the respective cylinders of the engine 1 simultaneously by way of fuel metering orifice 23 and fuel injection valves 5, 5', 5'', 5'''. The fuel flow supplied to the injection valves is limited by the control valve 22 as the fuel traverses the metering orifice 23. The fuel flow thus limited is decided by the opening degree of the control valve 22 driven by the pulse motor 21 driven in turn by the drive circuit 27 which is preset as a function of auxiliary elements such as the air/fuel ratio feedback control operable by output signals from sensors 8 and 10.

Thus, the amount of fuel supplied for injection to the injection nozzles is determined by the time intervals that the magnetic valves 18 and 19 are open, and the area of fuel passage defined by the control valve 22 and the metering orifice 23. The fuel injection valves 5, 5', 5'', 5''' are designed to open at a fuel pressure lower than the fuel pressure in the chamber 17 set by the device 25, so that the valves 5, 5', 5'', 5''' may open to permit fuel injection as long as the magnetic valves 18 and 19 are driven to equate the pressure in the chamber 17 with the pressure in the chamber 20.

It is seen from the foregoing that the fuel supply device of the present invention comprises a vortex flow sensor designed for producing a frequency output which is referenced to a vortex speed representative of the engine suction air quantity, a magnetic valve means driven for a predetermined time interval to permit fuel passage therethrough in timing with the frequency output signal from the vortex flow sensor, and a limit valve for limiting the fuel flow through the magnetic valve means. With such a supply device, the fuel may be supplied in a metered amount to a plurality of fuel injection valves and thence into the engine. The structure of the fuel supply device for a multicylinder engine may thus be simplified and the number of electro-magnetic valves needed for the metering of the fuel may be reduced. The electro-magnetic valve is not capable injecting the fuel and therefore may be reduced in size and cost and simpler in structure. A control valve is operative to change the amount of injected fuel as a function of supplemental control factors or requirements such as the suction air temperature or air/fuel ratio feedback control, so that the drive circuit for the electro-magnetic valves may be simplified and the fuel supply device may have better adaptability to other or existing engines.

Although the control valve 22 is driven by a pulse motor 21 in the foregoing embodiment, any other motor variety or proportional control electro-magnetic valves may be used within the scope of the present invention. Control factors such as engine temperatures, atmospheric pressure or engine speed may be utilized as supplemental factors for controlling the control valve 22.

What is claimed is:

1. A fuel supply device for a multicylinder engine having a plurality of fuel injection valves, said device comprising a vortex flow sensor for producing a frequency output referenced to a vortex speed which is representative of the flow of engine suction air and a fuel metering device including electro-magnetic valves which are driven for a predetermined time in synchronism with the frequency output from said vortex flow sensor so as to permit the passage of fuel therethrough, and a control valve for limiting the flow of fuel through said electro-magnetic valves, the fuel being supplied to said plurality of fuel injection valves in an amount metered by said fuel metering device and thereby injected into said engine; wherein each of said plurality of fuel injection valves is respectively provided for each cylinder.

2. The fuel supply device as claimed in claim 1, wherein said control valve comprises means for taking into account at least one of a plurality of supplemental control factors including engine temperature, atmospheric pressure, suction air temperature and the fedback value of the air/fuel ratio.

* * * * *